US005211136A

United States Patent [19]

Dacus et al.

[11] Patent Number: 5,211,136

[45] Date of Patent: May 18, 1993

[54] ENGINE COOLING APPARATUS

[76] Inventors: Gary T. Dacus, 10451 Brookhurst, Anaheim, Calif. 92804; Gregory L. Dacus, 13245 Fidler Ave., Downey, Calif. 90242

[21] Appl. No.: 868,662

[22] Filed: Apr. 15, 1992

[51] Int. Cl.[5] ..... F01P 11/00

[52] U.S. Cl. ..... 123/41.55; 123/41.01

[58] Field of Search ..... 123/41.01, 41.55

[56] References Cited

U.S. PATENT DOCUMENTS

| | | | |
|---|---|---|---|
| 2,481,135 | 9/1949 | Maness, Jr. et al. | 123/41.01 |
| 3,123,056 | 3/1964 | Kneblik | 123/41.01 |
| 4,494,384 | 1/1985 | Lott | 123/41.3 |
| 5,101,775 | 4/1992 | Hubbs | 123/41.01 |

*Primary Examiner*—Noah P. Kamen

*Attorney, Agent, or Firm*—Leon Gilden

[57] ABSTRACT

An engine cooling apparatus includes a fluid reservoir in fluid communication with a pump, the pump selectively directing fluid such as water under pressure to a series of nozzles mounted within a framework. The framework is positioned in surrounding relationship relative to an engine cooling radiator to direct selectively fluid onto the radiator to enhance evaporative cooling of the radiator. The invention is further arranged to optionally include a rotary blade structure mounted medially of the framework to direct fluid onto the radiator in concert with the nozzles.

2 Claims, 4 Drawing Sheets

ENGINE COOLING APPARATUS

BACKGROUND OF THE INVENTION

1. Field of the Invention

The field of invention relates to engine cooling structure, and more particularly pertains to a new and improved engine cooling apparatus wherein the same is arranged to direct cooling of evaporative fluid onto a heat exchanger.

2. Description of the Prior Art

At times engine cooling utilizing a conventional heat exchanger radiator becomes incapable of providing efficient cooling of an associated internal combustion engine. The use of such an engine in heavy stop and go traffic or when pulling greater loads subjects an internal combustion engine to greater heat, whereupon at intervals therefore, enhanced cooling of an internal combustion engine by enhanced efficiency of the heat exchanger is necessitated. The instant invention attempts to overcome deficiencies of the prior art by providing for nozzle structure to direct fluid spray on demand or alternatively engaged upon a thermal switch being actuated to direct engine cooling to fluid onto an associated heat exchange radiator.

Prior art apparatus of a radiator construction is set forth in U.S. Pat. No. 4,947,931 to Vitacco.

A condensing unit utilizing coils and blower fans is indicated in U.S. Pat. No. 4,926,655 to King.

As such, it may be appreciated that there continues to be a need for a new and improved engine cooling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of engine cooling apparatus now present in the prior art, the present invention provides an engine cooling apparatus wherein the same is arranged to provide for selective and predetermined fluid flow onto an internal combustion engine's radiator to enhance heat exchange of the radiator and the engine coolant. As such, the general purpose of the present invention, which will be described subsequently in greater detail, is to provide a new and improved engine cooling apparatus which has all the advantages of the prior art engine cooling apparatus and none of the disadvantages.

To attain this, the present invention provides an engine cooling apparatus including a fluid reservoir in fluid communication with a pump, the pump selectively directing fluid such as water under pressure to a series of nozzles mounted within a framework. The framework is positioned in surrounding relationship relative to an engine cooling radiator to direct selectively fluid onto the radiator to enhance evaporative cooling of the radiator. The invention is further arranged to optionally include a rotary blade structure mounted medially of the framework to direct fluid onto the radiator in concert with the nozzles.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine cooling apparatus which has all the advantages of the prior art engine cooling apparatus and none of the disadvantages.

It is another object of the present invention to provide a new and improved engine cooling apparatus which may be easily and efficiently manufactured and marketed.

It is a further object of the present invention to provide a new and improved engine cooling apparatus which is of a durable and reliable construction.

An even further object of the present invention is to provide a new and improved engine cooling apparatus which is susceptible of a low cost of manufacture with regard to both materials and labor, and which accordingly is then susceptible of low prices of sale to the consuming public, thereby making such engine cooling apparatus economically available to the buying public.

Still yet another object of the present invention is to provide a new and improved engine cooling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
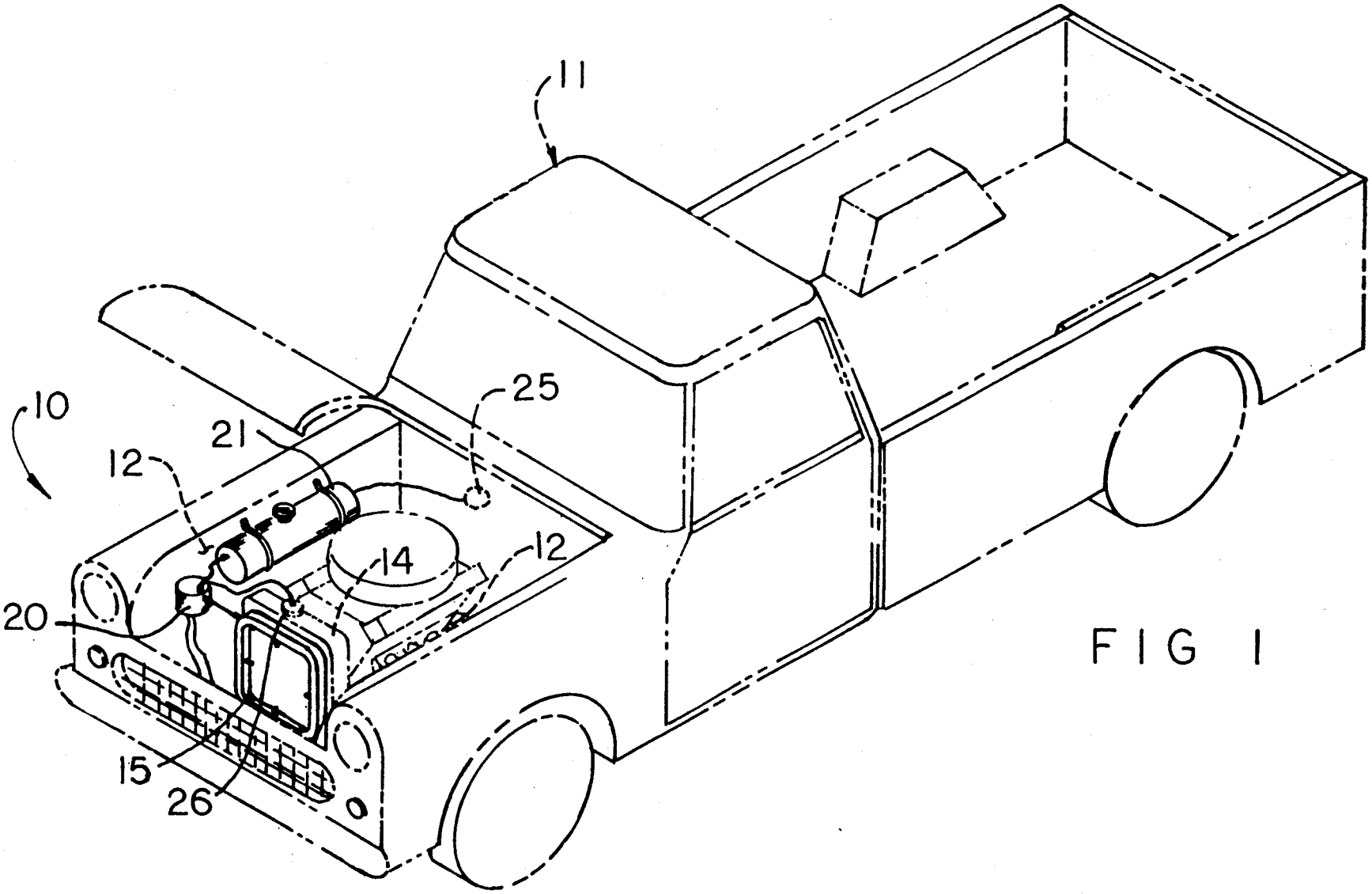
FIG. 1 is an isometric illustration of the instant invention.
Figure 2:
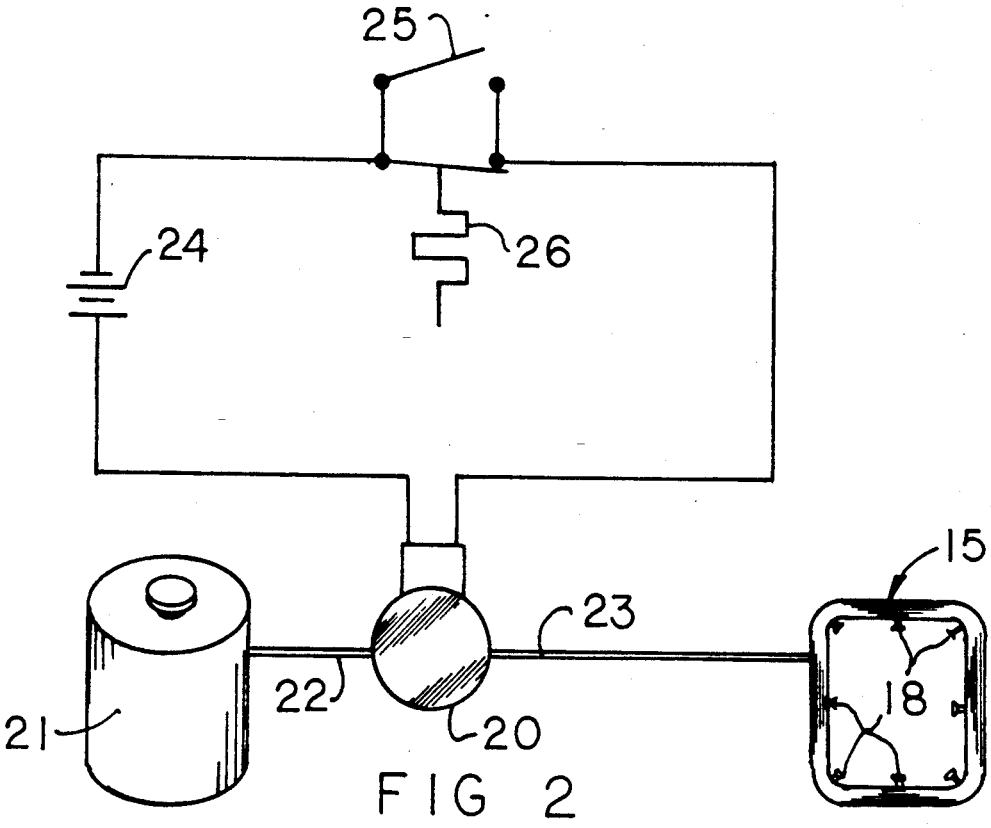
FIG. 2 is a diagrammatic illustration of the control circuitry of the instant invention in association with the fluid conduit structure.
Figure 3:
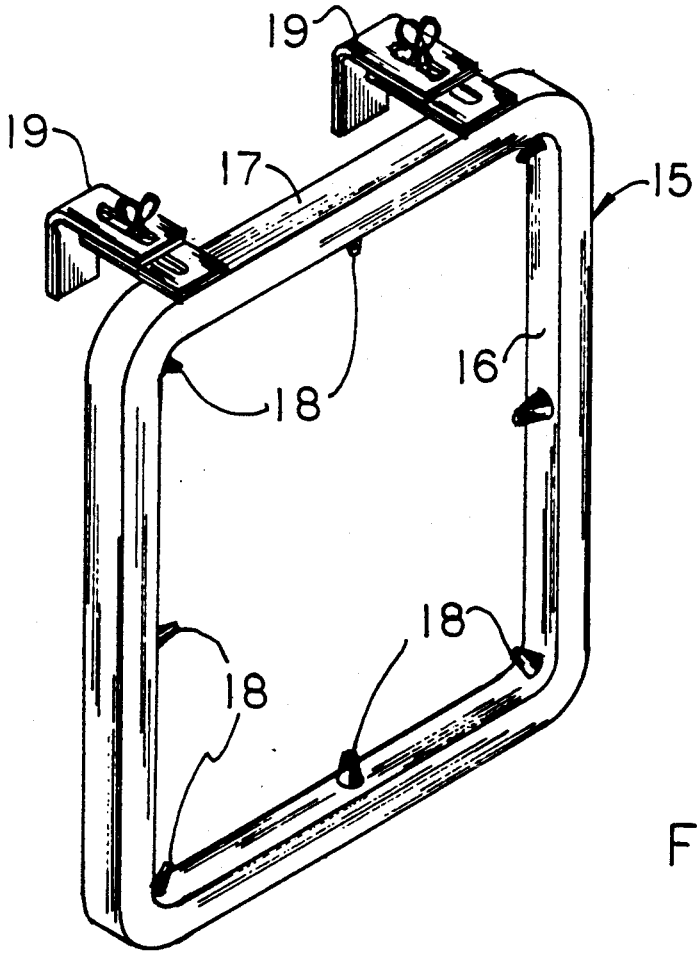
FIG. 3 is an isometric illustration of the perimeter framework utilized by the invention.
Figure 4:
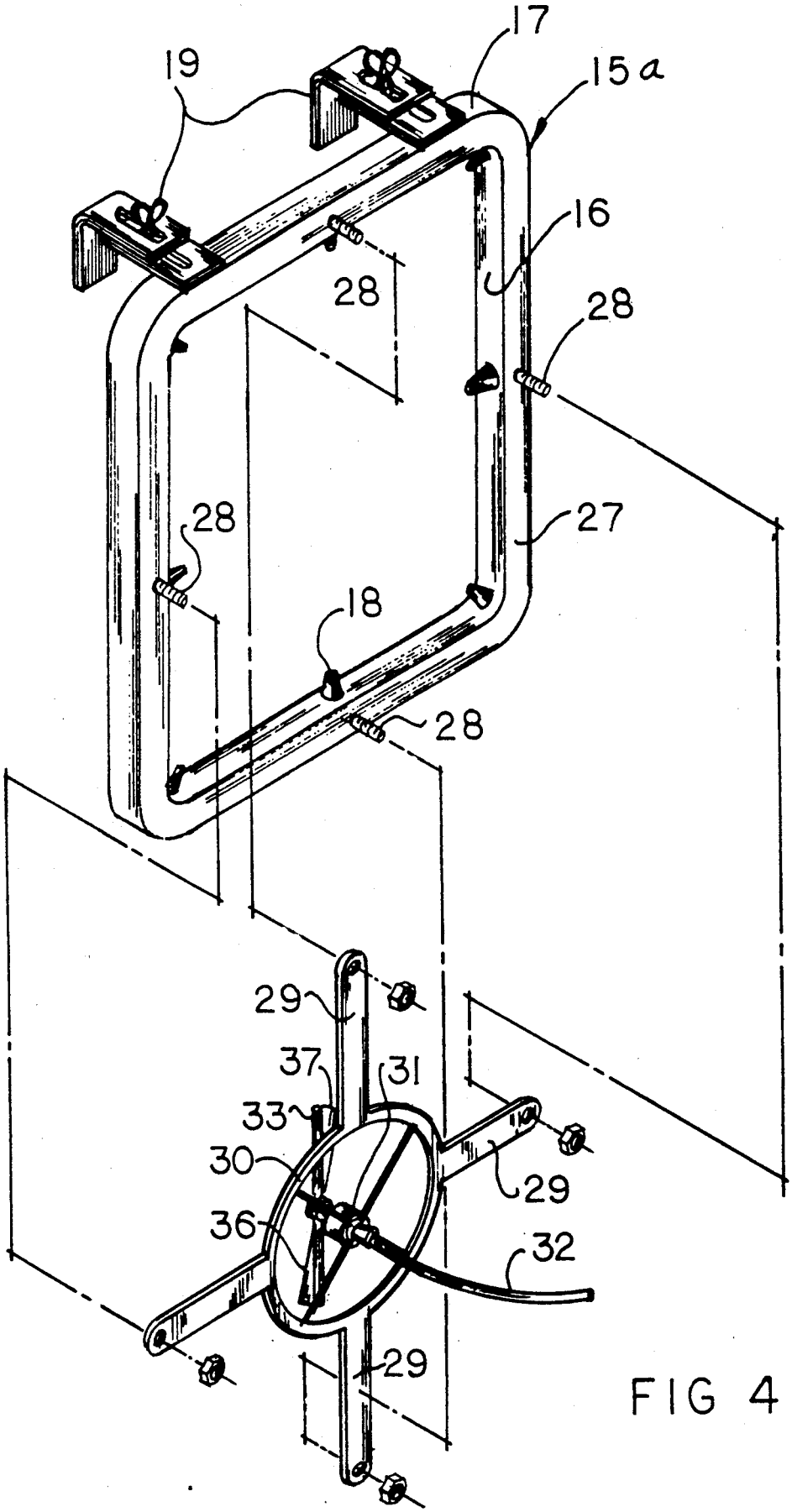
FIG. 4 is an isometric exploded illustration of a modified perimeter framework employing a rotary water dispensing blade structure.
Figure 5:
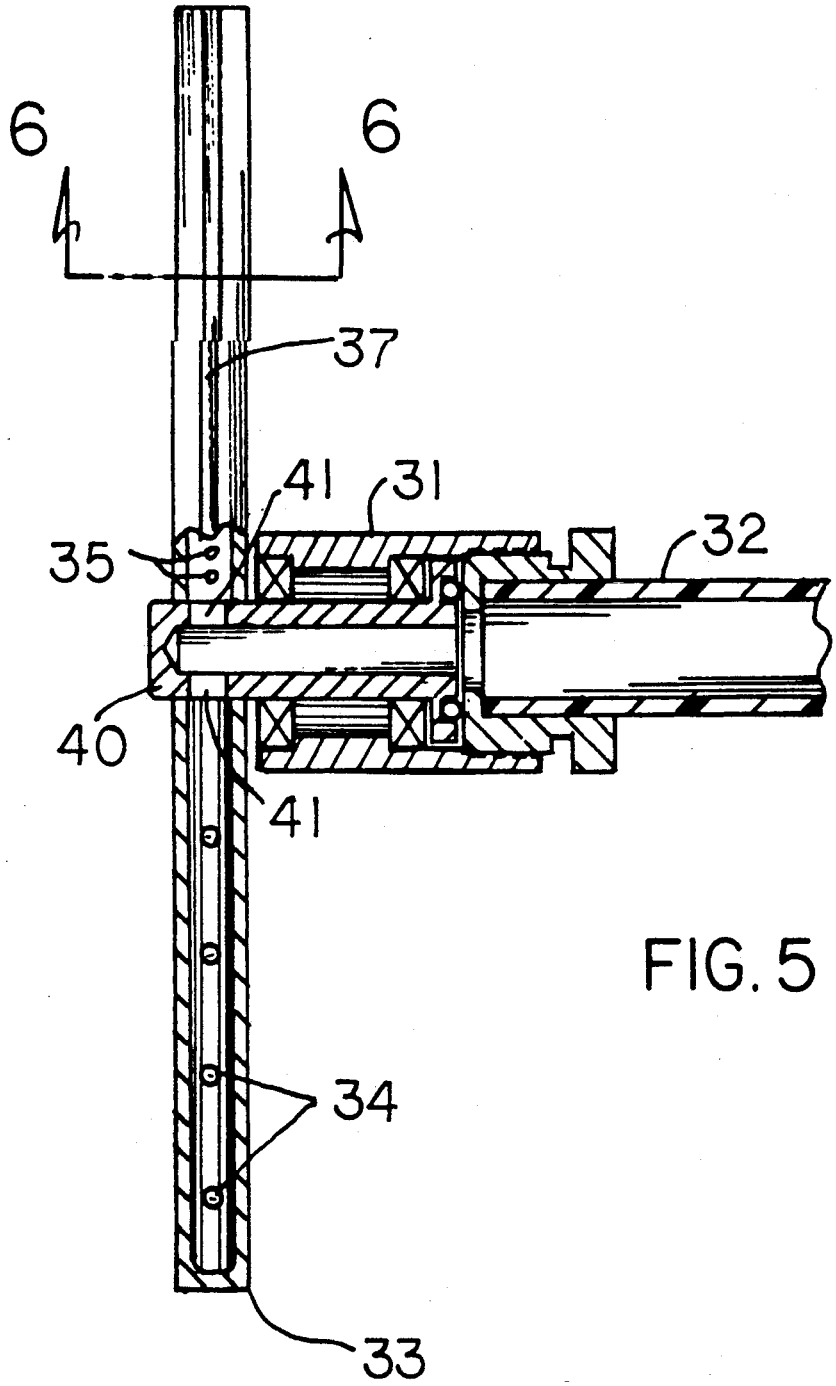
FIG. 5 is an enlarged orthographic view, partially in section, of the rotary blade structure.
Figure 6:
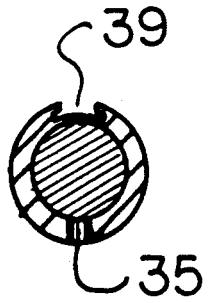
FIG. 6 is an orthographic view, taken along the lines 6—6 of FIG. 5 in the direction indicated by the arrows.

With reference now to the drawings, and in particular to FIGS. 1 to 6 thereof, a new and improved engine cooling apparatus embodying the principles and concepts of the present invention and generally designated by the reference numeral 10 will be described.

More specifically, the engine cooling apparatus 10 of the instant invention essentially comprises positioning within a self-propelled vehicle 11, and more specifically within the vehicle engine compartment 12. An internal combustion engine 13 of typical water cooled configuration is positioned within the engine compartment 12 in association with a radiator 14 (heat exchanger) of conventional construction. A perimeter framework 15 is mounted adjacent the radiator 14 in surrounding relationship thereto, as illustrated positioned forwardly thereof. The perimeter framework 15 is formed with a framework interior surface 16 and framework outer surface 17. A series of fluid ejector nozzles 18 are mounted to the interior framework 16 canted towards the radiator 14, as illustrated. As required, framework mounting brackets 19 are provided to secure the perimeter framework relative to the radiator 14 to maintain positioning of the perimeter framework relative to the radiator.

A pump 20 is provided in fluid communication with the fluid reservoir 21 through a first conduit 22, with a second conduit 23 directing fluid communication between the fluid reservoir 21 and the nozzles 18. A battery 24 (see FIG. 2) which may be the vehicle's battery is arranged in electrical communication between a temperature sensor switch 26 mounted to the radiator 14 and simultaneously, a manual over-ride switch 25 to permit manual operation and actuation of the pump 20, with the manual switch typically mounted within the vehicular passenger compartment of the associated vehicle 11.

The framework 15 is further indicated as a modified framework 15*a* in the FIGS. 4–7 structure to include a framework forward side wall 27 having a plurality of support boss members 28 orthogonally oriented relative to the forward side wall 27, with each support boss member 28 mounting a support flange 29 of a plurality of support flanges that are arranged in a coplanar relationship radially directed and integrally mounted to a support annular ring 30 medially oriented relative to the framework 15*a*. A rotary blade support hub 31 is fixedly mounted medially of the annular ring 30 having a third conduit 32 directed into the hub 32 that is in fluid communication with the second conduit 23. A rotary blade 33 fixedly mounted to a tubular support axle 40 has the tubular support axle 40 rotatably mounted within the hub 31 (see FIG. 5). The tubular support axle 40 is coaxially aligned with the forward distal end of the third conduit 32 to direct fluid through the support axle 40 into the hollow rotary blade 33. The rotary blade 33 has respective first and second nozzles 34 and 35 mounted about a first and second side of the rotary blade 33 on opposed sides of the support axle 40 to direct fluid flow onto the radiator 14. Triangular blades 36 and 37 are mounted within respective first and second grooves 38 and 39 that are arranged parallel relative to one another on opposed sides of the rotary blade 33 on opposed sides of the support axle 40, with the first and second nozzles 34 and 35 directed into the rotary blade 33 diametrically opposed to the respective first and second blades 36 and 37. The blades 36 and 37 are thusly removable relative to the associated first and second grooves 38 and 39, but when in position enhance atomization and distribution of fluid directed onto the radiator 14 within the framework 15*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An engine cooling apparatus arranged for positioning within a self-propelled vehicle, wherein the vehicle includes an engine compartment, and the engine compartment includes a radiator, wherein the apparatus comprises, a perimeter framework mounted adjacent the radiator in an internal relationship thereto, wherein the perimeter framework includes an interior surface spaced from an outer surface, and a framework forward side wall spaced from the radiator, and a plurality of spaced fluid injector nozzles fixedly mounted to the interior surface canted towards the radiator rearwardly of the forward side wall, and a pump mounted within the vehicle, and a fluid reservoir mounted within the vehicle, with a first conduit in fluid communication between the fluid reservoir and the pump, and a second conduit in fluid communication between the pump and the injector nozzles, and control means for effecting selective actuation of the pump upon fluid within the radiator reaching a predetermined temperature, and the control means includes a temperature sensor switch mounted relative to the radiator for sensing temperature within the radiator, and a manual switch mounted within the vehicle permitting manual actuation of the pump, and the framework forward side wall includes a plurality of support boss members, each boss member includes a support flange mounted to each boss member, and each flange is arranged in a coplanar relationship relative to one another, and the flanges are directed medially of the perimeter framework parallel to the forward side wall directed into a support annular ring, and the support angular ring mounting a rotary blade support hub medially thereof, and a third conduit in fluid communication with the second conduit to direct fluid to the support hub, and a rotary blade, and a tubular support axle directed medially and orthogonally relative to the rotary blade, with the tubular support axle rotatably mounted within the support hub, and the tubular support axle in fluid communication with the third conduit.

2. An apparatus as set forth in claim 1 wherein the rotary blade includes first nozzles directed along the rotary blade on a first side of the rotary blade, and a plurality of second nozzles mounted on a second side of the rotary blade, wherein the first and second nozzles are spaced on opposed sides of the axle, and a first groove directed into the rotary blade diametrically opposed to the first nozzles, and a second groove directed into the rotary blade diametrically opposed to the second nozzles, the first groove having a first triangular blade removably mounted relative to the first groove, and a second triangular blade removably mounted to the second groove within the rotary blade to enhance atomization of fluid directed to the radiator.

* * * * *